US012595537B2

(12) United States Patent
Kim et al.

(10) Patent No.: US 12,595,537 B2
(45) Date of Patent: Apr. 7, 2026

(54) TIN BLACKPLATE FOR PROCESSING AND METHOD FOR MANUFACTURING SAME

(71) Applicant: POSCO, Pohang-si (KR)

(72) Inventors: Jai-Ik Kim, Pohang-si (KR); Jea-Chun Jeon, Pohang-si (KR)

(73) Assignee: POSCO, Pohang-si (KR)

( * ) Notice: Subject to any disclaimer, the term of this patent is extended or adjusted under 35 U.S.C. 154(b) by 867 days.

(21) Appl. No.: 17/784,416

(22) PCT Filed: Dec. 16, 2020

(86) PCT No.: PCT/KR2020/018455
§ 371 (c)(1),
(2) Date: Jun. 10, 2022

(87) PCT Pub. No.: WO2021/125790
PCT Pub. Date: Jun. 24, 2021

(65) Prior Publication Data

US 2023/0002869 A1 Jan. 5, 2023

(30) Foreign Application Priority Data

Dec. 20, 2019 (KR) ..... 10-2019-0171864

(51) Int. Cl.

| | |
|---|---|
| ***C22C 38/04*** | (2006.01) |
| ***C21D 8/0221*** | (2026.01) |
| ***C21D 8/0247*** | (2026.01) |
| ***C21D 9/00*** | (2006.01) |
| ***C22C 38/00*** | (2006.01) |
| ***C22C 38/06*** | (2006.01) |
| ***C22C 38/42*** | (2006.01) |
| ***C22C 38/50*** | (2006.01) |
| ***C22C 38/54*** | (2006.01) |

(52) U.S. Cl.
CPC ..... *C22C 38/04* (2013.01); *C21D 8/0226* (2013.01); *C21D 8/0236* (2013.01); *C21D 8/0273* (2013.01); *C21D 9/0081* (2013.01); *C22C 38/001* (2013.01); *C22C 38/002* (2013.01); *C22C 38/06* (2013.01); *C22C 38/42* (2013.01); *C22C 38/50* (2013.01); *C22C 38/54* (2013.01)

(58) Field of Classification Search
CPC ..... C22C 38/04; C22C 38/001; C22C 38/002; C22C 38/06; C22C 38/42; C22C 38/50; C22C 38/54; C21D 8/0226; C21D 8/0236; C21D 8/0273; C21D 9/0081
See application file for complete search history.

(56) References Cited

U.S. PATENT DOCUMENTS 6,042,952 A * 3/2000 Aratani ..... C21D 8/0226 148/320

FOREIGN PATENT DOCUMENTS

| | | | | |
|---|---|---|---|---|
| CN | 1193293 | A | 9/1998 | |
| CN | 105803337 | A | 7/2016 | |
| CN | 106086643 | A | 11/2016 | |
| CN | 108118248 | A | 6/2018 | |
| CN | 109136777 | A | 1/2019 | |
| CN | 109136780 | A | 1/2019 | |
| CN | 115151668 | B | 10/2023 | |
| DE | 102014108335 | B3 | 10/2015 | |
| JP | S59-74233 | A | 4/1984 | |
| JP | H02-118026 | A | 5/1990 | |
| JP | 2002-239646 | A | 8/2002 | |
| JP | 2002-317248 | A | 10/2002 | |
| JP | 2007-197742 | A | 8/2007 | |
| JP | 2009-242857 | A | 10/2009 | |
| JP | 2010-150571 | A | 7/2010 | |
| JP | 7488901 | B2 | 5/2024 | |
| KR | 10-1999-014807 | A | 2/1999 | |
| KR | 10-2000-0034959 | A | 6/2000 | |
| KR | 10-0338705 | B1 | 10/2002 | |
| KR | 10-2004-0017946 | A | 3/2004 | |
| KR | 10-0470664 | B1 | 3/2005 | |
| KR | 10-2008-0106330 | A | 12/2008 | |
| KR | 10-2009-0007783 | A | 1/2009 | |
| KR | 10-2009-0068906 | A | 6/2009 | |
| KR | 10-1379973 | B1 | 4/2014 | |
| KR | 10-2016-0052866 | A | 5/2016 | |
| KR | 10-2016-0052868 | A | 5/2016 | |
| KR | 20160052866 | A * | 5/2016 | ..... C22C 38/004 |

OTHER PUBLICATIONS

Chinese Office Action dated Feb. 16, 2023 issued in Chinese Patent Application No. 202080097230.8.
International Search Report dated Jun. 3, 2021 issued in International Patent Application No. PCT/KR2020/018455 (with English translation).
Chinese Notice of Allowance dated Aug. 21, 2023 issued in Chinese Patent Application No. 202080097230.8.
(Continued)

*Primary Examiner* — Ricardo D Morales
(74) *Attorney, Agent, or Firm* — Morgan Lewis & Bockius LLP

(57) ABSTRACT

The present invention provides a tin blackplate for processing and a method for manufacturing the same.

The tin blackplate according to an exemplary embodiment of the present invention comprises: in % by weight, 0.0005 to 0.005% of carbon (C), 0.15 to 0.60% of manganese (Mn), 0.01 to 0.06% of aluminum (Al), 0.0005 to 0.004% of nitrogen (N), 0.0005 to 0.003% of boron (B), 0.01 to 0.035% of titanium (Ti), and the balance being iron (Fe) and inevitable impurities, and satisfies the following Formula 1.

$$4.8 \leq ([Ti]+[Al])/[N]-[B] \leq 12.5 \quad \text{[Equation 1]}$$

In this case, in Equation 1, [Ti], [Al], [N], and [B] mean each value obtained by dividing the content (% by weight) of Ti, Al, N, and B in the blackplate by each atomic weight thereof.

7 Claims, No Drawings

(56) References Cited

OTHER PUBLICATIONS

Japanese Office Action dated Sep. 5, 2023 issued in Japanese Patent Application No. 2022-538261.

Vietnamese Office Action dated Jul. 31, 2024 issued in Vietnamese Patent Application No. 1-2022-04527 (with English translation).

* cited by examiner

TIN BLACKPLATE FOR PROCESSING AND METHOD FOR MANUFACTURING SAME

CROSS-REFERENCE OF RELATED APPLICATIONS

This application is the U.S. National Phase under 35 U.S.C. § 371 of International Patent Application No. PCT/KR2020/018455, filed on Dec. 16, 2020, which in turn claims the benefit of Korean Application No. 10-2019-0171864, filed on Dec. 20, 2019, the entire disclosures of which applications are incorporated by reference herein.

TECHNICAL FIELD

The present invention relates to a tin blackplate for processing and a method for manufacturing the same. More specifically, the present invention relates to a tin blackplate having excellent workability and weldability, which is used for storage containers such as food/beverage cans, gas, and the like, and a method for manufacturing the same. Even more specifically, the present invention relates to a tin blackplate which prevents welded part bursts by optimizing steel components, manufacturing processes and the like to make the structure of a welding heat affected zone after welding finer and has excellent workability due to the control of solid solution elements in steel, and a method for manufacturing the same.

BACKGROUND ART

Surface-treated blackplates are subjected to various platings so as to be suitable for a use thereof in order to impart corrosion resistance or obtain beautiful surface characteristics. The steel plates plated as described above are referred to as surface-treated plated steel plates, and examples thereof include tinplates, galvanized steel plates, zinc-nickel-plated steel plates, and the like.

Although the surface-treated blackplates are variously classified according to the type of plating as described above, basically required characteristics such as formability and weldability need to be secured. Since most of the tin plates (TP) tin-plated on tin blackplates (BP), which are steel materials generally used as materials for cans, have a thin material thickness, the tinplates are evaluated by a temper grade measured with Hr30T (a measurement load of 30 kg and an auxiliary load of 3 kg are applied), which is a Rockwell surface hardness. Accordingly, the surface-treated blackplates may be classified into soft tin plates with temper grades T1 (Hr30T 49±3), T2 (Hr30T 53±3) and T3 (Hr30T 57±3) and hard tin plates with temper grades T4 (Hr30T 61±3), T5 (Hr30T 65±3) and T6 (Hr30T 70±3).

Tin blackplates, which are not tin-plated are also classified in a manner similar to the classification. Of the blackplates manufactured by a rolling method performed once, the main use of a soft blackplate with a temper grade of T3 or less is a part where workability is required, whereas a hard blackplate with a temper grade of T4 or more is widely used for parts requiring properties capable of withstanding internal properties by contents rather than workability, such as can bodies and lids (end and bottom).

In order to make a can for storing contents using a tin blackplate, tin (element symbol Sn) and the like are electroplated on the surface of the plate to impart corrosion resistance and the blackplate is cut to a certain size, and then, processed into a circular or square shape for use. Methods of processing a container are classified into a method of processing a container without welding, such as a 2-piece can consisting of two parts of a lid and a body and a method of fastening a body by welding or adhesion, such as a 3-piece can consisting of three parts of a body, a upper lid (end), and the lower lid (bottom).

A pipe manufacturing method without welding is subjected to a method of processing a container by drawing a tin plate or ironing the tin plate after drawing. Meanwhile, the pipe manufacturing method in which welding is performed is generally subjected to a method in which upper and lower lids are processed and attached to a body and a material cut from a disk as the body is joined to the lids into a circle by a resistance welding method such as wire seam welding. Cans that are processed into a circle according to the purpose of the container may be subjected to secondary processing by a processing process called expanding. Generally, 3-piece cans such as small beverage cans are processed into a circle and then a resistance welding method is suitable, but containers for storing cooking oil, paint, and the like may be subjected to expanding processing in a circumferential direction after welding so as to be advantageous for storage and transportation. Therefore, in the case of materials used for these uses, not only workability but also resistance weldability need to be excellent. When a container is processed by the welding method, if a defect occurs in a welded part, not only is it difficult to store a content due to the leak of the content, but also burst occurs in a welding heat affected zone during a secondary processing such as expanding, and thus the defected container cannot be used as a container. Therefore, since tinplates applied to uses for processing containers by the resistance welding method not only need to improve the characteristics of welded parts, but also are mainly used for parts that are subjected to intense processing, workability also needs to be improved at the same time.

A blackplate for processing, which is used as a material for containers that require a high degree of processing, has been mainly manufactured by a batch annealing method, but in this case, there were problems in that productivity deteriorates because it takes a lot of time for the heat treatment, and a material for a product was non-uniform for each part. Therefore, recently, the proportion of manufacturing by a continuous annealing method, which has low production costs, uniform materials, excellent flatness and surface characteristics, has been increasing. However, when a material for processing with a temper grade of T3 grade is produced by the continuous annealing method, the material is subjected to a tin-melting step performed to make an alloy of a tin layer in the tinning process as low-carbon aluminum killed steel is used or a baking process for drying an organic material such as lacquer in the pipe manufacturing process, but in this process, as an aging phenomenon is caused by solid solution elements in steel, when a can is processed, there is a problem of inducing processing defects such as fluting that the can is bent into a square or a stretcher strain that induces striped defects on the surface of steel plates. Therefore, when a blackplate for processing with a temper grade of T3 grade is manufactured by the continuous annealing method, studies have been made to improve formability by suppressing aging characteristics to prevent fluting or stretcher strain.

DISCLOSURE

Technical Problem

The present invention has been made in an effort to provide a tin blackplate for processing and a method for manufacturing the same. More specifically, the present invention has been made in an effort to provide a tin blackplate having excellent workability and weldability, which is used for storage containers such as food/beverage cans, gas, and the like, and a method for manufacturing the same. Even more specifically, the present invention has been made in an effort to provide a tin blackplate which prevents welded part bursts by optimizing steel components, manufacturing processes and the like to make the structure of a welding heat affected zone after welding finer and has excellent workability due to the control of solid solution elements in steel, and a method for manufacturing the same.

Technical Solution

The tin blackplate according to an exemplary embodiment of the present invention comprises: in % by weight, 0.0005 to 0.005% of carbon (C), 0.15 to 0.60% of manganese (Mn), 0.01 to 0.06% of aluminum (Al), 0.0005 to 0.004% of nitrogen (N), 0.0005 to 0.003% of boron (B), 0.01 to 0.035% of titanium (Ti), and the balance being iron (Fe) and inevitable impurities, and satisfies the following Formula 1.

$$4.8 \leq ([Ti]+[Al])/[N]-[B] \leq 12.5 \quad \text{[Formula 1]}$$

In this case, in Formula 1, [Ti], [Al], [N], and [B] mean each value obtained by dividing the content (% by weight) of Ti, Al, N, and B in the blackplate by each atomic weight thereof.

The tin blackplate may further include 0.03% or less (except for 0%) of silicon (Si), 0.01 to 0.03% of phosphorus (P), 0.003 to 0.015% of sulfur (S), 0.02 to 0.15% of chromium (Cr), 0.01 to 0.1% of nickel (Ni), and 0.02 to 0.15% of copper (Cu).

The tin blackplate may further satisfy the following Formula 2.

$$0.015 \leq [Mn]*[Cu]/[S] \leq 0.050 \quad \text{[Formula 2]}$$

In this case, in Formula 2, [Mn], [Cu], and [S] mean each value obtained by dividing the content (% by weight) of Mn, Cu, and S in the blackplate by each atomic weight thereof.

The tin blackplate may further satisfy the following Formula 3.

$$0.8 \leq ([Ti]-[N])/[C] \leq 2.5 \quad \text{[Formula 3]}$$

In this case, in Formula 3, [Ti], [N], and [C] mean each value obtained by dividing the content (% by weight) of Ti, N, and C in the blackplate by each atomic weight thereof.

The tin blackplate may have a surface hardness (Hr30T) of 54 to 60.

In the tin blackplate, the difference in average particle diameter between a base material part and a welding heat affected zone after resistance welding may be less than 3 μm.

The tin blackplate after being treated with tin melting and baking may have a yield point elongation of less than 0.5%.

The tin blackplate according to an exemplary embodiment of the present invention includes a tin-plated layer(s) located on one or both surfaces of the above-mentioned tin blackplate.

The method for manufacturing a tin blackplate for processing according to an exemplary embodiment of the present invention includes: manufacturing a slab including: in by weight, 0.0005 to 0.005% of carbon (C), 0.15 to 0.60% of manganese (Mn), 0.01 to 0.06% of aluminum (Al), 0.0005 to 0.004% of nitrogen (N), 0.0005 to 0.003% of boron (B), 0.01 to 0.035% of titanium (Ti), and the balance being iron (Fe) and inevitable impurities, and satisfying the following Formula 1; heating the slab; manufacturing a hot-rolled steel plate by hot-rolling the heated slab; winding the hot-rolled steel plate; manufacturing a cold-rolled steel plate by cold-rolling the wound hot-rolled steel plate at a rolling reduction ratio of 80 to 95%; and annealing the cold-rolled steel plate in a temperature range of 680 to 780° C.

$$4.8 \leq ([Ti]+[Al])/[N]-[B] \leq 12.5 \quad \text{[Formula 1]}$$

In this case, in Formula 1, [Ti], [Al], [N], and [B] mean each value obtained by dividing the content (% by weight) of Ti, Al, N, and B in the blackplate by each atomic weight thereof.

The heating of the slab may be heating the slab to 1150 to 1280° C.

A finishing hot-rolling temperature in the manufacturing of the hot-rolled steel plate by hot-rolling the heated slab may be 890 to 950° C.

A winding temperature of the winding of the hot-rolled steel plate may be 600 to 720° C.

After the annealing of the cold-rolled steel plate, temper-rolling the annealed cold-rolled steel plate to less than 3% may be further included.

Advantageous Effects

The tin blackplate according to an exemplary embodiment of the present invention has excellent welding resistance and workability. Specifically, the tin blackplate has excellent strength, welding resistance, expandability and workability by adding suitable amounts of alloying elements such as boron (B), chromium (Cr) and titanium (Ti) using ultra-low carbon steel and optimizing the addition ratios of these elements.

The tin blackplate according to an exemplary embodiment exhibits excellent physical properties when applied to a part requiring the fatigue characteristics of a welded part due to a use of applying the secondary processing after the resistance welding and a continuous use. In addition, it is possible to suppress the generation of fluting and stretcher strain due to deformation aging during baking and reflow processing.

In the tin blackplate according to an exemplary embodiment of the present invention, productivity is improved by appropriately controlling components and optimizing manufacturing processes.

The tin blackplate according to an exemplary embodiment of the present invention can be used for containers such as food and drink pipes, pressure-resistant pipes, and pail cans by controlling alloying elements. Furthermore, as work efficiency is enhanced by strengthening welding characteristics, the tin blackplate according to an exemplary embodiment of the present invention is easily applied to a use for expansion.

The tin blackplate according to an exemplary embodiment of the present invention requires the addition of an alloying element essential for obtaining a material with a temper grade of T3. In this regard, when an excessive amount of alloying element is contained, the material with a temper grade of T3 can be stably secured by adding a certain amount of copper (Cu), nickel (Ni), and chromium (Cr), instead of reducing the addition amount of manganese (Mn) that degrades workability due to a segregation phenomenon.

The tin blackplate according to an exemplary embodiment of the present invention is present as a coarse precipitate, and thus can secure aging resistance by adding titanium (Ti)

and boron (B) that immobilize solid solution nitrogen, solid solution carbon, and the like without suppressing ferrite recrystallization.

The tin blackplate according to an exemplary embodiment of the present invention can suppress cracks of a welded part by adding boron (B) capable of suppressing the abnormal growth of a heat affected zone (HAZ) structure by transforming the heat affected zone structure into ferrite during resistance welding, and further controlling excessive boron values to make particles of the welded heat affected zone finer.

MODE FOR INVENTION

In the present specification, terms such as first, second and third are used to describe various parts, components, regions, layers and/or sections, but are not limited thereto. These terms are used only to distinguish one part, component, region, layer or section from another part, component, region, layer or section. Thus, a first part, component, region, layer, or section to be described below could be termed a second part, component, region, layer, or section within a range not departing from the scope of the present invention.

When one part "includes" one constituent element in the present specification, unless otherwise specifically described, this does not mean that another constituent element is excluded, but means that another constituent element may be further included.

The terminology used herein is solely for reference to specific exemplary embodiments and is not intended to limit the present invention. The singular forms used herein also include the plural forms unless the phrases do not express the opposite meaning explicitly. As used herein, the meaning of "include" specifies a specific feature, region, integer, step, action, element and/or component, and does not exclude the presence or addition of another feature, region, integer, step, action, element, and/or component.

In the present specification, the term "combination thereof" included in the Markush type expression means a mixture or combination of one or more selected from the group consisting of constituent elements described in the Markush type expression, and means including one or more selected from the group consisting of the above-described constituent elements.

In the present specification, when a part is referred to as being "above" or "on" another part, it may be directly above or on another part or may be accompanied by another part therebetween. In contrast, when one part is referred to as being "directly above" another part, no other part is interposed therebetween.

Although not differently defined, all terms including technical terms and scientific terms used herein have the same meaning as the meaning that is generally understood by a person with ordinary skill in the art to which the present invention pertains. The terms defined in generally used dictionaries are additionally interpreted to have the meaning matched with the related art document and currently disclosed contents, and are not interpreted to have an ideal meaning or a very formal meaning as long as the terms are not defined.

Further, unless otherwise specified, % means wt %, and 1 ppm is 0.0001 wt %.

In an exemplary embodiment of the present invention, further including an additional element means that the additional element is included while replacing iron (Fe) that is the balance by an additional amount of the additional element.

Hereinafter, exemplary embodiments of the present invention will be described in detail with reference to the accompanying drawings such that a person with ordinary skill in the art to which the present invention pertains can easily carry out the present invention. However, the present invention may be implemented in various different forms, and is not limited to the exemplary embodiments described herein.

The tin blackplate according to an exemplary embodiment of the present invention comprises: in % by weight, 0.0005 to 0.005% of carbon (C), 0.15 to 0.60% of manganese (Mn), 0.01 to 0.06% of aluminum (Al), 0.0005 to 0.004% of nitrogen (N), 0.0005 to 0.003% of boron (B), 0.01 to 0.035% of titanium (Ti), and the balance being iron (Fe) and inevitable impurities, and satisfies the following Formula 1.

$$4.8 \leq ([Ti]+[Al])/[N]-[B] \leq 12.5 \quad \text{[Formula 1]}$$

In this case, in Formula 1, [Ti], [Al], [N], and [B] mean each value obtained by dividing the content (% by weight) of Ti, Al, N, and B in the blackplate by each atomic weight thereof.

The tin blackplate may further include 0.03% or less (except for 0%) of silicon (Si), 0.01 to 0.03% of phosphorus (P), 0.003 to 0.015% of sulfur (S), 0.02 to 0.15% of chromium (Cr), 0.01 to 0.1% of nickel (Ni), and 0.02 to 0.15% of copper (Cu).

Further, the tin blackplate may further satisfy the following Formula 2.

$$0.01 \leq \leq [Mn]*[Cu]/[S] \leq 0.050 \quad \text{[Formula 2]}$$

In this case, in Formula 2, [Mn], [Cu], and [S] mean each value obtained by dividing the content (% by weight) of Mn, Cu, and S in the blackplate by each atomic weight thereof.

In addition, the tin blackplate may further satisfy the following Formula 3.

$$0.8 \leq ([Ti]-[N])/[C] \leq 2.5 \quad \text{[Formula 3]}$$

In this case, in Formula 3, [Ti], [N], and [C] mean each value obtained by dividing the content (% by weight) of Ti, N, and C in the blackplate by each atomic weight thereof.

Hereinafter, the components of the tin blackplate and the reasons for the limitation of Formulae 1 to 3 will be described.

Carbon (C): 0.0005 to 0.005 wt %

Carbon (C) is an element added to improve the strength of steel, and is an element added to make a welding heat affected zone have characteristics similar to those of a base material. When the content of C was too low, the above-described effects were insufficient. In contrast, when the content of C is too high, a supersaturated solid solution carbon is increased to act as a factor that causes deformation aging, and the yield point elongation is high, causing processing defects such as fluting during can processing. Furthermore, the amount of carbon nitride-forming element added to improve workability against aging such as fluting resistance was increased to increase the manufacturing cost, and acted as a factor to increase the annealing temperature during heat treatment. Accordingly, the content of C may be 0.0005 to 0.005%. More specifically, the content of C may be 0.001 to 0.004%.

Manganese (Mn): 0.15 to 0.60 wt %

Manganese (Mn) is a solid solution strengthening element, and serves to increase the strength of steel and improve hot workability. When the content of Mn is too low, it may cause red shortness and it may be difficult to contribute to the stabilization of austenite. In contrast, when the content of Mn is too high, a large amount of manganese-sulfide (MnS) precipitates are formed, so that there are problems in that the ductility and workability of steel deteriorate, the too high content of Mn serves as a factor of center segregation, and rollability deteriorates. Accordingly, the content of Mn may be 0.15 to 0.60%. More specifically, the content of Mn may be 0.20 to 0.57%.

Silicon (Si): 0.03 wt % or Less

Silicon (Si) not only may serve as a factor which degrades the surface characteristics and reduce corrosion resistance by combining with oxygen to form an oxide layer on the surface of a steel plate, but also serves as a factor which induces cracks in a welded part by promoting a hard phase transformation in the weld metal during resistance welding. Accordingly, the content of Si is limited to 0.03% or less. More specifically, the content of Si may be 0.001 to 0.02%.

Phosphorus (P): 0.010 to 0.030 wt %

Phosphorus (P) is an element which improves strength and hardness by causing solid solution strengthening while being present as a solid solution element in steel. When the content of P is too low, it may be difficult to maintain a certain level of rigidity, whereas when the amount of P is too high, center segregation occurs during casting, ductility deteriorates, and as a result, the workability may deteriorate. Accordingly, the content of P may be 0.01 to 0.03%. More specifically, the content of P may be 0.013 to 0.028%.

Sulfur (S): 0.003 to 0.015 wt %

Since sulfur combines with manganese in steel to form non-metal inclusions and cause red shortness and also combines with titanium to form precipitates, unless the content of sulfur is strictly controlled, the amount of expensive manganese and titanium added is significantly changed, so that the content range of sulfur generally needs to be kept at a low level by a certain part because it is difficult to control the additive elements for obtaining a non-aging T3 material in the steelmaking process. Further, when the content of S is high, there may be a problem of reducing the base material toughness of the steel plate, so that the content of S may be 0.003 to 0.015%. More specifically, the content of S may be 0.004 to 0.014%.

Aluminum (Al): 0.01 to 0.06 wt %

Aluminum (Al) is an element added for the purpose of preventing a material from deteriorating by a deoxidizer and aging in an aluminum killed steel, and is also effective for securing ductility, and such an effect is more remarkable than at extremely low temperature. In contrast, when the content of Al is too high, surface inclusions such as aluminum-oxide ($Al_2O_3$) are rapidly increased to cause the surface characteristics of a hot-rolled material to deteriorate, and not only the workability deteriorates, but also ferrite is locally formed at the crystal grain boundary of the welding heat affected zone, so that there may a problem in that mechanical characteristics deteriorate. Accordingly, the content of Al may be 0.01 to 0.06%. More specifically, the content of Al may be 0.015 to 0.055%.

Nitrogen (N): 0.0005 to 0.004 wt %

Nitrogen (N) is an element that is effective for strengthening materials, such as increasing hardness while being present in a solid solution state in steel. When N is included in too small an amount, it may be difficult to secure the target rigidity. In contrast, when the content of N is too high, not only aging properties rapidly deteriorate and the workability deteriorates, but also N may react with boron added to improve the weldability and the like to form precipitates, and thus may act as a factor of increasing the annealing temperature and reducing the weldability. Accordingly, the content of N may be 0.0005 to 0.004%. More specifically, the content of N may be 0.001 to 0.0035%.

Chromium (Cr): 0.02 to 0.15 wt %

Chromium (Cr) is an element added for solid solution strengthening, and has problems in that at 0.02% or less, it is difficult to obtain the strengthening effect, and when 0.15% or more of N is added, it is advantageous in terms of increasing hardness, but corrosion resistance deteriorates and the manufacturing costs are increased due to the use of expensive chromium. Accordingly, the content of Cr may be 0.02 to 0.15%. More specifically, the content of Cr may be 0.03 to 0.12%.

Nickel (Ni): 0.01 to 0.1 wt %

Nickel (Ni) is an element that not only is effective for improving ductility, but also forms a stable structure even at extremely low temperature and improves low-temperature toughness, and 0.01% or more of nickel needs to be added in order to obtain such an effect. In contrast, when nickel is added in an amount of more than 0.1%, there is a problem in that not only the workability deteriorates but also surface defects are induced, and the steelmaking costs are remarkably increased as a large amount of fundamentally expensive Ni is added. Accordingly, the content of Ni may be 0.01 to 0.10%. More specifically, the content of Ni may be 0.02 to 0.09%.

Copper (Cu): 0.02 to 0.15 wt %

Copper (Cu) is an element added for corrosion resistance and solid solution strengthening, and has problems in that when the content is 0.02% or less, it is difficult to obtain the target effect, and when copper is added in too large an amount, copper induces surface defects during continuous casting and acts as a cause of low temperature cracks at high temperature. Accordingly, the content of Cu may be 0.02 to 0.15%. More specifically, the content of Cu may be 0.03 to 0.12%.

Boron (B): 0.0005 to 0.0030 wt %

Boron (B) acts as an element that suppresses the abnormal growth of a heat affected zone structure by enhancing hardenability to turn the welding heat affected zone structure which is a major factor of welding cracks into transformation ferrite, and when boron is added in too small an amount, boron becomes a cause of cracks in the welded part as the effect as described above cannot be obtained. In contrast, when B is added in too large an amount, there is a problem in that the not only annealing workability is reduced by increasing the recrystallization temperature, but also the workability deteriorates. Accordingly, the content of B may be 0.0005 to 0.003%. More specifically, the content of B may be 0.0008 to 0.0025%.

Titanium (Ti): 0.010 to 0.035 wt %

Special element-free ultra-low carbon steel has problems in that defects such as stretcher strain or fluting during processing of a can are generated by causing a deformation aging in the reflow of the plating process and the baking treatment procedure of the pipe manufacturing process by elements present in a solid solution state in steel. In order to prevent this problem, titanium added as a carbon nitride-forming element is present as a relatively coarse precipitate by controlling the addition amount, and thus does not significantly suppress recrystallization and also serves to improve the workability and promote the stability of the welded part by boron by immobilizing nitrogen. For this purpose, Ti needs to be added in an amount of 0.01% or more, and when too much Ti is added, there is a problem in that the annealing workability of an ultra-thin material deteriorates. Accordingly, the content of Ti may be 0.01 to 0.035%. More specifically, the content of Ti may be 0.012 to 0.033%.

Meanwhile, in the tin blackplate according to an exemplary embodiment of the present invention, the excess boron value of Formula 1, ([Ti]+[Al])/[N]−[B] needed to be limited to 4.8 to 12.5.

Further, in the tin blackplate according to an exemplary embodiment of the present invention, [Mn]*[Cu]/[S] of Formula 2 and ([Ti]−[N])/[C] of Formula 3 may be 0.015 to 0.050 and 0.8 to 2.5, respectively.

$$4.8 \leq ([Ti]+[Al])/[N]-[B] \leq 12.5 \text{(excess boron value)} \quad \text{[Formula 1]}$$

In order to suppress cracks in the welded part by making crystal grains in the welding heat affected zone during resistance welding finer, boron (non-precipitated boron, that is, excess boron) solid-soluted in steel needs to be present, but when such excess boron is present at 12.5 or more, the recrystallization temperature is increased and the workability deteriorates, whereas when excess boron is present at 4.8 or less, abnormal growth of the welding heat affected zone structure cannot be suppressed, so that there is a problem in that a crack phenomenon in the welded part during resistance welding, such as wire-seam, occurs. Accordingly, the excess boron value, Formula 1 ([Ti]+[Al])/[N]−[B] may be 4.8 to 12.5. More specifically, the excess boron value, Formula 1 ([Ti]+[Al])/[N]−[B] may be 5.0 to 12.3.

$$0.015 \leq [Mn]*[Cu]/[S] \leq 0.050 \quad \text{[Formula 2]}$$

The content may be adjusted such that the atomic ratio [Mn]*[Cu]/[S] of sulfur to manganese and copper among the elements contained as described above is in a range of 0.015 to 0.050. There were problems in that when the atomic ratio of sulfur to manganese and copper was too small, red shortness was generated and workability deteriorated, whereas when the atomic ratio was too high, segregation and surface defects were increased. Accordingly, the [Mn]*[Cu]/[S] atomic ratio may be 0.015 to 0.050. More specifically, the [Mn]*[Cu]/[S] atomic ratio of Formula 2 may be 0.016 to 0.048.

$$0.8 \leq ([Ti]-[N])/[C] \leq 2.5 \quad \text{[Formula 3]}$$

Meanwhile, since titanium acting as a carbon nitride-forming element forms carbides, nitrides, and the like in addition to sulfur, workability, weldability, and the like may be secured only by controlling the amount of titanium added along with the amount of carbon and nitrogen. In order to stably produce a tin blackplate having excellent weldability and workability, the ([Ti]−[N])/[C] atomic ratio needed to be controlled. When the ([Ti]−[N])/[C] atomic ratio is too low, an aging phenomenon occurs in the tin-melting and baking process, and thus acts as a factor that remarkably degrades workability. In contrast, when the ([Ti]−[N])/[C] atomic ratio is too high, the recrystallization phenomenon is remarkably suppressed, so that the heat treatment workability of the ultra-thin material deteriorates, leading to fatal defects such as heat buckle. Accordingly, the ([Ti]−[N])/[C] atomic ratio may be 0.8 to 2.5. More specifically, the ([Ti]−[N])/[C] atomic ratio may be 0.82 to 2.38.

The tin blackplate according to an exemplary embodiment of the present invention may have excellent surface hardness characteristics. More specifically, the tin blackplate may have a surface hardness (Hr30T) of 54 to 60. In the case of a material for a welded pipe, after plating and printing, the material passes through a multi-stage roll to take a certain shape, and a body part welding work for joining is performed. In this case, when the quality of the material is not uniform, the degree of drying of the processed body part is different, which may cause welding failure. Therefore, it is required that the surface hardness value of the material before the processing has a certain range. By satisfying such physical properties, the material may be preferably applied as a target tin blackplate for processing. When the surface hardness is too low, the degree of processing of the body part of the can becomes so large during processing that there is a problem in that the welded portions overlap each other. In contrast, when the surface hardness is too high, there is a problem in that the weld line is not formed because the roll processing is not properly performed. More specifically, the surface hardness may be 55 to 59.

Further, the tin blackplate according to an exemplary embodiment of the present invention may have excellent welded part structure uniformity. More specifically, the difference in average crystal grain particle diameter between a base material part and a welding heat affected zone after resistance welding may be less than 3 μm. The structure uniformity of the weld part is indicated by the difference in crystal grain size between the welding heat affected zone and the base material of the welded pipe manufactured from the tin blackplate according to an exemplary embodiment of the present invention. After resistance welding, the difference in average crystal grains between the base material and the welding heat affected zone may be less than 3 μm. When the structure uniformity of the welded part is higher than 3 μm, there is a problem in that cracks occur mainly in the heat affected zone where the crystal grains are large due to the difference in crystal grain size for each part during processing such as pipe expansion after welding. More specifically, the structure uniformity may be less than 2.5 μm.

Here, the particle diameter means the diameter of a sphere, assuming a sphere having the same volume as the particle.

In addition, the tin blackplate according to an exemplary embodiment of the present invention may have excellent workability after tin-melting and baking. Specifically, the yield point elongation may be less than 0.5% even after the tin-melting treatment at about 240° C. performed in the tin plating process and the baking treatment in a range of 180 to 220° C. for drying organic materials in the pipe manufacturing process. When the yield point elongation is high, the tin blackplate is exposed to surface defects such as bending or wrinkle generation during processing, and the high yield point elongation causes processing cracks during processing such as pipe expansion, so that welded pipes for processing need to be strictly controlled. More specifically, the yield point elongation may be less than 0.3%.

Meanwhile, the tin blackplate according to an exemplary embodiment of the present invention includes a tin-plated layer(s) located on one or both surfaces of the above-mentioned tin blackplate.

The method for manufacturing a tin blackplate according to an exemplary embodiment of the present invention includes: manufacturing a slab including: in by weight, 0.0005 to 0.005% of carbon (C), 0.15 to 0.60% of manganese (Mn), 0.01 to 0.06% of aluminum (Al), 0.0005 to 0.004% of nitrogen (N), 0.0005 to 0.003% of boron (B), 0.01 to 0.035% of titanium (Ti), and the balance being iron (Fe) and inevitable impurities, and satisfying the following Formula 1; heating the slab; manufacturing a hot-rolled steel plate by hot-rolling the heated slab; winding the hot-rolled steel plate; manufacturing a cold-rolled steel plate by cold-rolling the wound hot-rolled steel plate at a rolling reduction ratio of 80 to 95%; and annealing the cold-rolled steel plate in a temperature range of 680 to 780° C.

$$4.8 \leq ([Ti]+[Al])/[N]-[B] \leq 12.5 \quad \text{[Formula 1]}$$

In this case, in Formula 1, [Ti], [Al], [N], and [B] mean each value obtained by dividing the content (% by weight) of Ti, Al, N, and B in the blackplate by each atomic weight thereof.

Hereinafter, the method will be specifically described for each step.

First, a slab is manufactured. In the steelmaking step, C, Mn, Si, P, S, Al, N, Ti, B, Cr, Cu, Ni, and the like are controlled with appropriate contents. The molten steel whose components are adjusted in the steelmaking step is manufactured into a slab through continuous casting.

Since each composition of the slab has been described in detail in the above-described tin blackplate, the duplicate description thereof will be omitted. Since the alloy components are not substantially changed in the tin blackplate manufacturing process, the alloy components of the slab and the finally manufactured tin blackplate may be the same.

Next, the slab is heated. To smoothly perform the subsequent hot rolling process and subject the slab to homogenization treatment, the slab may be heated to 1150 to 1280° C. When the slab heating temperature is too low, there is a problem in that the rollability deteriorates because the load is sharply increased during the subsequent thermal rolling, whereas when the slab heating temperature is too high, not only the energy costs are increased but also the surface scale generation is increased to generate the loss of materials. More specifically, the slab heating temperature may be 1180 to 1250° C.

Next, a hot-rolled steel plate is manufactured by hot-rolling the heated slab. In this case, the finishing hot-rolling temperature may be 890 to 950° C. When the finishing rolling temperature is too low, the crystal grains may be rapidly mixed as the hot rolling in the low-temperature region is finished, thereby leading to deterioration in hot rollability and workability. In contrast, when the finishing rolling temperature is too high, the peelability of the surface scale is lowered, and uniform hot rolling is not performed over the entire thickness, which may cause shape defects. More specifically, the finishing rolling temperature may be 900 to 940° C.

Next, the hot-rolled steel plate is wound. In this case, the winding temperature may be 600 to 720° C. After hot rolling and before winding, the hot-rolled steel plate may be cooled on a run-out table (ROT). When the winding temperature is too low, the temperature inhomogeneity in the width direction causes a difference in the formation behavior of low-temperature precipitates during cooling and maintenance to induce material deviation and adversely affect workability. In contrast, even though the winding temperature is too high, the fine structure becomes coarse, so that there is a problem in that the surface material is softened and defects such as orange-peel are induced during pipe manufacturing. More specifically, the winding temperature may be 610 to 700° C.

After winding the hot-rolled steel plate and before cold-rolling the wound hot-rolled steel plate, the method may further include washing the wound hot-rolled steel plate with an acid.

Next, a cold-rolled steel plate is manufactured by cold-rolling the wound hot-rolled steel plate. In this case, the rolling reduction ratio is 80 to 95%. When the cold-rolling reduction ratio is too low, the driving force for recrystallization is so low that it is difficult to secure a uniform material such as local structure growth, and further, considering the thickness of a final product, there is a problem in that the hot rolling workability remarkably deteriorates as a whole, for example, the thickness of the hot-rolled plate needs to be made sufficiently thin. In contrast, when the rolling reduction ratio is too high, there is a problem in that the cold rolling workability deteriorates due to an increase in load on a rolling mill. Accordingly, the rolling reduction ratio may be 80 to 95%. More specifically, the rolling reduction ratio may be 85 to 91%.

Next, the cold-rolled steel plate is annealed. By annealing from a state where the strength is increased due to the deformation introduced from cold rolling, the target strength and workability may be secured. In this case, the annealing temperature is 680 to 780° C. When the annealing temperature is too low, the deformation formed by rolling is not sufficiently removed, so that there is a problem in that the workability is significantly reduced, whereas when the annealing temperature is too high, it is difficult to control the tension in the furnace by high-temperature annealing during continuous annealing, so that there is a problem in that not only the mass flow deteriorates but also defects such as heat buckle during an annealing work are induced. More specifically, the annealing temperature may be 700 to 770° C.

After the annealing of the cold-rolled steel plate, temper-rolling the annealed cold-rolled steel plate may be further included. Although the shape of the material may be controlled and the target surface roughness may be obtained through temper rolling, there is a problem in that when the temper rolling reduction ratio is too high, the material is cured but workability deteriorates, so that temper rolling may be applied at a rolling reduction ratio of 3% or less. More specifically, the temper rolling reduction ratio may be 0.3 to 2.0%.

Meanwhile, a tin-plated layer may be formed by electroplating tin on one or both sides of the manufactured tin blackplate. A tinplate may be manufactured by forming a tin-plated layer.

Hereinafter, the present invention will be described in more detail through the examples. However, such examples are merely for exemplifying the present invention, and the present invention is not limited thereto.

EXAMPLES

After a slab of an aluminum killed steel configured as shown in the following Table 1 was heated to 123000, hot rolling, winding, cold rolling, and continuous annealing were performed under the manufacturing conditions summarized in the following Table 2, and then a tin blackplate to which a temper rolling reduction ratio of 1.2% was applied was obtained.

TABLE 1

| Steel type | Alloy composition (wt %) | | | | | | | | | | | | Formula 1 | Formula 2 | Formula 3 |
|---|---|---|---|---|---|---|---|---|---|---|---|---|---|---|---|
| | C | Mn | Si | P | S | Al | N | Cr | Ni | Cu | Ti | B | | | |
| Inventive Steel 1 | 0.0024 | 0.46 | 0.012 | 0.017 | 0.008 | 0.034 | 0.0028 | 0.06 | 0.03 | 0.05 | 0.028 | 0.0018 | 9.2 | 0.026 | 1.92 |
| Inventive Steel 2 | 0.0018 | 0.38 | 0.009 | 0.024 | 0.006 | 0.028 | 0.0017 | 0.04 | 0.05 | 0.08 | 0.019 | 0.0012 | 11.8 | 0.046 | 1.83 |
| Inventive Steel 3 | 0.0032 | 0.51 | 0.018 | 0.016 | 0.011 | 0.044 | 0.0031 | 0.09 | 0.04 | 0.04 | 0.032 | 0.0024 | 10.4 | 0.017 | 1.67 |
| Inventive Steel 4 | 0.0038 | 0.29 | 0.015 | 0.021 | 0.009 | 0.023 | 0.0034 | 0.11 | 0.06 | 0.11 | 0.025 | 0.0019 | 5.7 | 0.032 | 0.88 |
| Comparative Steel 1 | 0.0025 | 0.25 | 0.011 | 0.052 | 0.01 | 0.008 | 0.0027 | 0.04 | 0 | 0.28 | 0.007 | 0 | 2.3 | 0.064 | −0.23 |
| Comparative Steel 2 | 0.0017 | 0.42 | 0.007 | 0.007 | 0.034 | 0.026 | 0.0019 | 0 | 0.02 | 0.03 | 0.052 | 0.0011 | 15.1 | 0.003 | 6.69 |
| Comparative Steel 3 | 0.0096 | 0.08 | 0.022 | 0.013 | 0.008 | 0.092 | 0.0038 | 0.07 | 0.05 | 0.05 | 0.018 | 0.0017 | 13.9 | 0.005 | 0.13 |
| Comparative Steel 4 | 0.0272 | 0.36 | 0.312 | 0.017 | 0.007 | 0.027 | 0.0064 | 0.38 | 0.34 | 0 | 0.049 | 0.0001 | 4.4 | 0.000 | 0.25 |
| Comparative Steel 5 | 0.0431 | 0.82 | 0.017 | 0.005 | 0.027 | 0.002 | 0.0021 | 0.24 | 0 | 0.19 | 0 | 0.0045 | 0.5 | 0.052 | -0.04 |
| Comparative Steel 6 | 0.0722 | 0.21 | 0.021 | 0.051 | 0.006 | 0.035 | 0.0014 | 0.85 | 0.03 | 0.04 | 0.032 | 0.0012 | 19.6 | 0.013 | 0.09 |
| Comparative Steel 7 | 0.0026 | 0.32 | 0.009 | 0.021 | 0.009 | 0.012 | 0.0034 | 0.05 | 0.04 | 0.07 | 0.021 | 0.0011 | 3.6 | 0.023 | 0.90 |
| Comparative Steel 8 | 0.0031 | 0.44 | 0.011 | 0.018 | 0.007 | 0.049 | 0.0024 | 0.04 | 0.03 | 0.06 | 0.033 | 0.0021 | 14.6 | 0.034 | 2.00 |

In this case, Formulae 1 to 3 were calculated with the following values.

$$([Ti]+[Al])/[N]-[B] \quad \text{[Formula 1]}$$

$$[Mn]*[Cu]/[S] \quad \text{[Formula 2]}$$

$$([Ti]-[N])/[C] \quad \text{[Formula 3]}$$

Here, [Ti] is a value obtained by dividing the content (% by weight) of Ti in the plated steel plate by an atomic weight (48).

[Al] is a value obtained by dividing the content (% by weight) of Al in the plated steel plate by an atomic weight (27).

[N] is a value obtained by dividing the content (% by weight) of N in the plated steel plate by an atomic weight (14).

[B] is a value obtained by dividing the content (% by weight) of B in the plated steel plate by an atomic weight (11).

[Mn] is a value obtained by dividing the content (% by weight) of Mn in the plated steel plate by an atomic weight (55).

[Cu] is a value obtained by dividing the content (% by weight) of Cu in the plated steel plate by an atomic weight (64).

[S] is a value obtained by dividing the content (% by weight) of S in the plated steel plate by an atomic weight (32).

[C] is a value obtained by dividing the content (% by weight) of C in the plated steel plate by an atomic weight (12).

TABLE 2

| Classification | Steel type No. | Finishing hot-rolling temperature (° C.) | Winding temperature (° C.) | Cold-rolling reduction ratio (%) | Annealing temperature (° C.) |
|---|---|---|---|---|---|
| Inventive Example 1 | Inventive Steel 1 | 910 | 680 | 88 | 710 |
| Inventive Example 2 | Inventive Steel 1 | 910 | 680 | 88 | 730 |
| Inventive Example 3 | Inventive Steel 1 | 910 | 680 | 88 | 750 |
| Inventive Example 4 | Inventive Steel 2 | 930 | 620 | 86 | 720 |
| Inventive Example 5 | Inventive Steel 2 | 930 | 620 | 86 | 750 |
| Inventive Example 6 | Inventive Steel 3 | 920 | 660 | 90 | 740 |
| Inventive Example 7 | Inventive Steel 4 | 920 | 620 | 90 | 720 |
| Inventive Example 8 | Inventive Steel 4 | 920 | 620 | 90 | 740 |
| Comparative Example 1 | Inventive Steel 1 | 800 | 680 | 88 | 620 |
| Comparative Example 2 | Inventive Steel 1 | 910 | 680 | 72 | 740 |
| Comparative Example 3 | Inventive Steel 2 | 930 | 480 | 96 | 720 |
| Comparative Example 4 | Inventive Steel 3 | 920 | 780 | 90 | 820 |
| Comparative Example 5 | Comparative Steel 1 | 920 | 620 | 86 | 740 |
| Comparative Example 6 | Comparative Steel 2 | 910 | 620 | 86 | 740 |
| Comparative Example 7 | Comparative Steel 3 | 910 | 620 | 86 | 740 |
| Comparative Example 8 | Comparative Steel 4 | 910 | 620 | 86 | 720 |
| Comparative Example 9 | Comparative Steel 5 | 910 | 620 | 86 | 720 |

TABLE 2-continued

| Classification | Steel type No. | Finishing hot-rolling temperature (° C.) | Winding temperature (° C.) | Cold-rolling reduction ratio (%) | Annealing temperature (° C.) |
|---|---|---|---|---|---|
| Comparative Example 10 | Comparative Steel 6 | 910 | 620 | 96 | 740 |
| Comparative Example 11 | Comparative Steel 7 | 900 | 620 | 86 | 730 |
| Comparative Example 12 | Comparative Steel 8 | 920 | 640 | 88 | 740 |

Various characteristics of these tin blackplates were measured, and the results are shown in the following Table 3.

The mass flow was displayed as "O" when there was no rolling load during cold and hot rolling and no defects such as heat buckle occurred during continuous annealing, and was displayed as "X" when a rolling load occurred or defects such as strip breakage occurred during continuous annealing.

Surface hardness values measured with Hr30T with a main load of 30 kg and an auxiliary load of 3 kg using a Rockwell surface hardness device are shown.

Resistance weldability was indicated as "good" when no breakage occurred in the resistance welded part by utilizing these tin-plated plates, processing the plates, then performing resistance welding such as wire-seam, and then applying a pipe expansion of 3%, and was indicated as "poor" when breakage at the welded part occurred.

In a welded pipe in which the body part of a material manufactured by each material and manufacturing method is welded, average crystal grain particle diameters are measured in a base material part, which is a matrix part that is not affected by the heat of welding and a welding heat affected zone, which is a part adjacent to the welded part, respectively, and then the difference in crystal grain sizes for each welded part is shown by measuring the difference in average crystal grains size between these two parts.

In the case of yield point elongation, a value obtained by performing a tensile test on a test piece in which a tin blackplate was subjected to tin-melting heat treatment at 2400° for 3 seconds and then baking treatment again at 200° for 20 minutes was shown.

TABLE 3

| Classification | Mass flow | Surface hardness (Hr30T) | Resistance weldability | Difference (μm) in crystal grain sizes for each welded part | Yield point elongation (%) | Workability |
|---|---|---|---|---|---|---|
| Inventive Example 1 | ○ | 58.2 | Good | 1.2 | 0.0 | Good |
| Inventive Example 2 | ○ | 57.5 | Good | 1.4 | 0.0 | Good |
| Inventive Example 3 | ○ | 56.8 | Good | 1.5 | 0.0 | Good |
| Inventive Example 4 | ○ | 56.3 | Good | 0.9 | 0.0 | Good |
| Inventive Example 5 | ○ | 55.5 | Good | 1.8 | 0.0 | Good |
| Inventive Example 6 | ○ | 58.6 | Good | 1.3 | 0.0 | Good |
| Inventive Example 7 | ○ | 57.1 | Good | 1.7 | 0.0 | Good |
| Inventive Example 8 | ○ | 56.2 | Good | 2.1 | 0.1 | Good |
| Comparative Example 1 | X | 68.9 | Poor | 4.2 | 0.4 | Poor |
| Comparative Example 2 | ○ | 48.7 | Poor | 3.3 | 0.6 | Poor |
| Comparative Example 3 | X | 62.4 | Poor | 5.1 | 0.7 | Poor |
| Comparative Example 4 | X | 45.2 | Poor | 3.6 | 0.5 | Poor |
| Comparative Example 5 | ○ | 46.9 | Poor | 6.4 | 3.1 | Poor |
| Comparative Example 6 | ○ | 44.8 | Poor | 4.5 | 0.4 | Poor |
| Comparative Example 7 | ○ | 52.6 | Poor | 3.9 | 4.2 | Poor |
| Comparative Example 8 | ○ | 61.4 | Poor | 7.3 | 4.8 | Poor |
| Comparative Example 9 | ○ | 64.2 | Poor | 6.2 | 6.4 | Poor |
| Comparative Example 10 | X | 68.9 | Poor | 4.6 | 7.1 | Poor |
| Comparative Steel 11 | ○ | 55.3 | Poor | 4.2 | 0.2 | Poor |
| Comparative Steel 12 | X | 57.4 | Poor | 3.1 | 0.0 | Good |

As can be seen from Tables 1 to 3, Invention Examples 1 to 8 satisfying all of the alloy composition and manufacturing conditions of the present invention not only have good mass flow but also correspond to a surface hardness of 54 to 60 and a yield point elongation of less than 0.5%, which are the material standards of the target tin blackplate. Therefore, defects such as fluting and stretcher strain or processing cracks did not occur during processing, so that excellent workability could be secured. In addition, the difference in crystal grain size for each welded part was 5 μm or less, and good resistance weldability could also be obtained.

In contrast, Comparative Examples 1 to 4 are cases where the alloy composition presented in the present invention were satisfied, but the manufacturing conditions were not satisfied, and have a problem in that the rolling mass flow (Comparative Examples 1 and 3) and the annealing mass flow (Comparative Example 4) were poor. In addition, it can be confirmed that the surface hardness was higher (Comparative Examples 1 and 3) or lower (Comparative Examples 2 and 4) than the target, the difference in grain size for each welded part was 3 μm or more, and the resistance weldability was poor, such as generation of cracks in the welding heat affected zone during pipe expansion and cracks occurred in the welding heat affected zone during processing, so that as a whole, the target characteristics of the tin blackplate could not be secured.

Comparative Examples 5 to 9 are cases where the manufacturing conditions presented in the present invention are satisfied but the alloy composition is not satisfied, and Comparative Example 10 is a case where none of alloy composition and manufacturing conditions are satisfied. Most of Comparative Examples 5 to 10 could not satisfy the target surface hardness, resistance weldability, difference in crystal grains for each welded part, yield point elongation, workability, and the like of the present invention, and Comparative Example 10 could not secure the target characteristics because the mass flow was also not good, so that there was a problem in that various defects occurred during processing. Even in the cases of Comparative Examples 11 and 12, there was a problem in that the crystal grain size for each welded part became large due to the inability to satisfy the excess boron control standard, so that the resistance weldability was secured.

The present invention is not limited to the Examples, but may be prepared in various forms, and a person with ordinary skill in the art to which the present invention pertains will understand that the present invention can be implemented in another specific form without changing the technical spirit or essential feature of the present invention. Therefore, it should be understood that the above-described examples are only illustrative in all aspects and not restrictive.

The invention claimed is:

1. A tin blackplate comprising: in % by weight, 0.0005 to 0.005% of carbon (C), 0.15 to 0.60% of manganese (Mn), 0.01 to 0.06% of aluminum (Al), 0.0005 to 0.004% of nitrogen (N), 0.0005 to 0.003% of boron (B), 0.01 to 0.035% of titanium (Ti), and the balance being iron (Fe) and inevitable impurities, and satisfying the following Formulas 1 and 3:

$$5.0 \leq ([Ti]+[Al])/[N]-[B] \leq 12.3 \quad \text{[Formula 1]}$$

(in Formula 1, [Ti], [Al], [N], and [B] mean each value obtained by dividing the content (% by weight) of Ti, Al, N, and B in the blackplate by each atomic weight thereof)

$$0.82 \leq ([Ti]-[N])/[C] \leq 2.5 \quad \text{[Formula 3]}$$

(in Formula 3, [Ti], [N], and [C] mean each value obtained by dividing the content (% by weight) of Ti, N, and C in the blackplate by each atomic weight thereof.

2. The tin blackplate of claim 1, further comprising: in % by weight, 0.03% or less (except for 0%) of silicon (Si), 0.01 to 0.03% of phosphorus (P), 0.003 to 0.015% of sulfur(S), 0.02 to 0.15% of chromium (Cr), 0.01 to 0.1% of nickel (Ni), and 0.02 to 0.15% of copper (Cu).

3. The tin blackplate of claim 2, further satisfying the following Formula 2:

$$0.015 \leq [Mn]*[Cu]/[S] \leq 0.050 \quad \text{[Formula 2]}$$

(in Formula 2, [Mn], [Cu], and [S] mean each value obtained by dividing the content (% by weight) of Mn, Cu, and S in the blackplate by each atomic weight thereof).

4. The tin blackplate of claim 1, wherein the tin blackplate has a surface hardness (Hr30T) of 54 to 60.

5. The tin blackplate of claim 1, wherein in the tin blackplate, a difference in average crystal grain particle diameter between a base material part and a welding heat affected zone after resistance welding is less than 3 μm.

6. The tin blackplate of claim 1, wherein the tin blackplate after being treated with tin-melting and baking has a yield point elongation of less than 0.5%.

7. A tinplate comprising a tin-plated layer(s) located on one or both surfaces of the tin blackplate described in claim 1.

* * * * *